US007979922B2

(12) United States Patent
Ronco

(10) Patent No.: US 7,979,922 B2
(45) Date of Patent: Jul. 19, 2011

(54) PROTECTIVE DEVICE

(75) Inventor: Luigi Ronco, Molvena VI (IT)

(73) Assignee: Dainese S.p.A., Molvena (IT)

( * ) Notice: Subject to any disclaimer, the term of this patent is extended or adjusted under 35 U.S.C. 154(b) by 1002 days.

(21) Appl. No.: 11/791,207

(22) PCT Filed: Nov. 22, 2005

(86) PCT No.: PCT/IB2005/053865

§ 371 (c)(1),
(2), (4) Date: Aug. 17, 2007

(87) PCT Pub. No.: WO2006/054273

PCT Pub. Date: May 26, 2006

(65) Prior Publication Data

US 2007/0289051 A1 Dec. 20, 2007

(30) Foreign Application Priority Data

Nov. 22, 2004 (IT) ..... RM2004A0572
Jul. 1, 2005 (IT) ..... RM2005A0350

(51) Int. Cl.

| | |
|---|---|
| ***A41D 27/26*** | (2006.01) |
| ***A41D 13/00*** | (2006.01) |
| ***A41D 13/06*** | (2006.01) |
| ***A41D 27/12*** | (2006.01) |

(52) U.S. Cl. ..... 2/459; 2/24; 2/62

(58) Field of Classification Search ..... 2/459, 460, 2/461, 462, 24, 23, 22, 16, 62, 59
See application file for complete search history.

(56) References Cited

U.S. PATENT DOCUMENTS

| | | | |
|---|---|---|---|
| 4,324,003 | A | 4/1982 | Johnston |
| 4,325,148 | A | 4/1982 | Livernois et al. |
| 5,060,314 | A | 10/1991 | Lewis |
| 5,123,408 | A | 6/1992 | Gaines |
| 5,530,966 | A | 7/1996 | West et al. |
| 5,611,080 | A | 3/1997 | Skottheim et al. |

(Continued)

FOREIGN PATENT DOCUMENTS

GB 2 345 436 7/2000

OTHER PUBLICATIONS

International Search Report for PCT/IB2005/053865 mailed Apr. 6, 2006.

*Primary Examiner* — Alissa L Hoey
*Assistant Examiner* — Amber R Anderson
(74) *Attorney, Agent, or Firm* — Nixon & Vanderhye P.C.

(57) ABSTRACT

A protective device, in particular of a type suitable for use during sports activities to protect in case of knocks, falls and impacts in general, comprises at least one substantially rigid main protective element, apt to be applied at a region to be protected, at least one substantially rigid ancillary protective element, apt to be applied in a position next to the main protective element and connecting means for connecting the ancillary protective element to the main protective element apt to allow the mutual rotation working as hinge about a main axis. The connecting means comprises deformable connections between the protective elements so that the connecting means allow, besides said rotation, also rotations along axes different from said main axis and/or limited translation motions nearing thereto and/or away therefrom.

20 Claims, 9 Drawing Sheets

U.S. PATENT DOCUMENTS

| | | | | |
|---|---|---|---|---|
| 5,898,939 | A | 5/1999 | Schramm et al. | |
| 6,178,556 | B1 | 1/2001 | Foreman et al. | |
| 6,305,031 | B1 | 10/2001 | White | |
| 6,308,345 | B1 | 10/2001 | Williams, Jr. | |
| 6,553,579 | B1 * | 4/2003 | Gillen et al. | 2/268 |
| 2004/0060100 | A1 | 4/2004 | Reiterman | |
| 2004/0193085 | A1 | 9/2004 | Mazzarolo | |

* cited by examiner

PROTECTIVE DEVICE

This application is the U.S. national phase of International Application No. PCT/IB2005/053865 filed 22 Nov. 2005 which designated the U.S. and claims priority to IT RM2004A000572 filed 22 Nov. 2004 and IT RM2005A000350 filed 1 Jul. 2005, the entire contents of each of which are hereby incorporated by reference.

The present invention refers to a protective device, in particular of a type suitable for use during sports activities to protect in case of knocks, falls and impacts in general. It is widely known that activities such as motor biking, but also skiing, skating, biking and anyhow when high-speed extreme motions are envisaged, can easily lead to falls, in which a number of body zones are particularly at risk of injury.

Knees, wrists, elbows, shoulders, neck and back are often the parts most hit by falls during these activities, both as these usually are the parts first contacting the ground, and as they have no layer of muscle or fatty tissue that may cushion knocks, as instead happens for hips and buttocks.

To mitigate consequences of falls and impacts in general there are a plurality of protections worn-on by those doing activities taking place at high speeds, or that anyhow can be defined as extreme.

A first category of products suitable therefor envisages the use of a single rigid element that is fastened at the zone to be protected, so as to cover said zone and shield it from impacts. Different materials and geometries of the protective element are used to improve the strength thereof and increase the capacity of dissipating impact energy; however such protective solutions generally offer protection exclusively in a limited portion of the body.

On the other hand, evidently said protections are applied, generally by means of strings or seams onto the garment, directly at the zone to be protected and, to avoid hampering body motions, the protective element should be small-sized.

In fact, when considering e.g. an elbow protection, a single large-sized element can hardly adapt in an effective manner, and without limiting motions, to all configurations that the arm may assume: when at extended arm, the zone of the joint basically develops in a rectilinear manner, at folded arm the same zone instead has an acute vertex.

Hence, evidently a single large-sized element, which therefore would allow a high protection, cannot adapt to both configurations.

To assure a higher protective surface, there are used plural elements applied to a garment side-by-side the one to the other, so as not to hamper the user's mobility. However, the partitioning zones between two elements prove critical, as offering scarce or nil protection to impacts.

The solution generally adopted is based on a compromise between freedom of motion, protection level and wearability.

In an attempt to overcome such a drawback, there is a second typology of products composed of plural parts joined and articulated thereamong so as to offer a cover not only in the region corresponding to the zone to be protected, but also in the portions immediately adjacent thereto, thereby basically assuring a higher protection from impacts with respect to the preceding case.

For instance, in case of an elbow protection, it is desirable that there be protected not only the joint-related zone, but also the arm and forearm portions that are immediately adjacent thereto.

Likewise, when the zone to be protected is the neck it is advisable that also shoulder and back be at least partially protected.

By following these contrivances, the protective elements assure a greater surface defending from impacts; thus, the possibility for a body to sustain lesions in case of fall or knock is surely smaller with respect to what takes place with protections covering a limited body zone, as in the preceding case.

Such protections, having a greater protective surface with respect to the preceding case, are made with the use of two or more elements connected therebetween by means of movable connections such as hinges or alike junctions.

The drawback of these movable connections is that in general they are unable to concomitantly ensure a high degree of defense from impacts, constructive simplicity and high mobility for the user.

In fact, in order to adequately protect, protections should not leave regions exposed to impacts, not even in the junction zones among the various elements composing them; however, when implementing this feature the mobility left to the user by the protection fades.

Other times, in order to make products highly defending and anyhow leaving freedom of motion, solutions exceedingly complex from the constructive standpoint are resorted to, becoming difficult and costly to produce and above all complex to wear on for the user.

Hence, the technical problem underlying the present invention is to provide a protection to be used during sports or anyhow extreme activities, overcoming the drawbacks mentioned above with reference to the known art.

Such a problem is solved by a protective device, in particular of a type suitable for use during sports activities to protect in case of falls, knocks and impacts in general, according to claim 1, by the related method for the making thereof according to claim 15, and by the garment according to claim 17.

The present invention provides several relevant advantages. The main advantage lies in that the present invention allows, by means of a protection of simple constructive implementation, to provide, by different elements cooperating thereamong, a high degree of defense in case of knocks and impacts in general, making an ample protective surface, without however hampering the normal freedom of the joint.

Other advantages, features and the operation modes of the present invention will be made evident from the following detailed description of some embodiments thereof given by way of a non-limiting example. Reference will be made to the figures of the annexed drawings, wherein.

Figure 1:
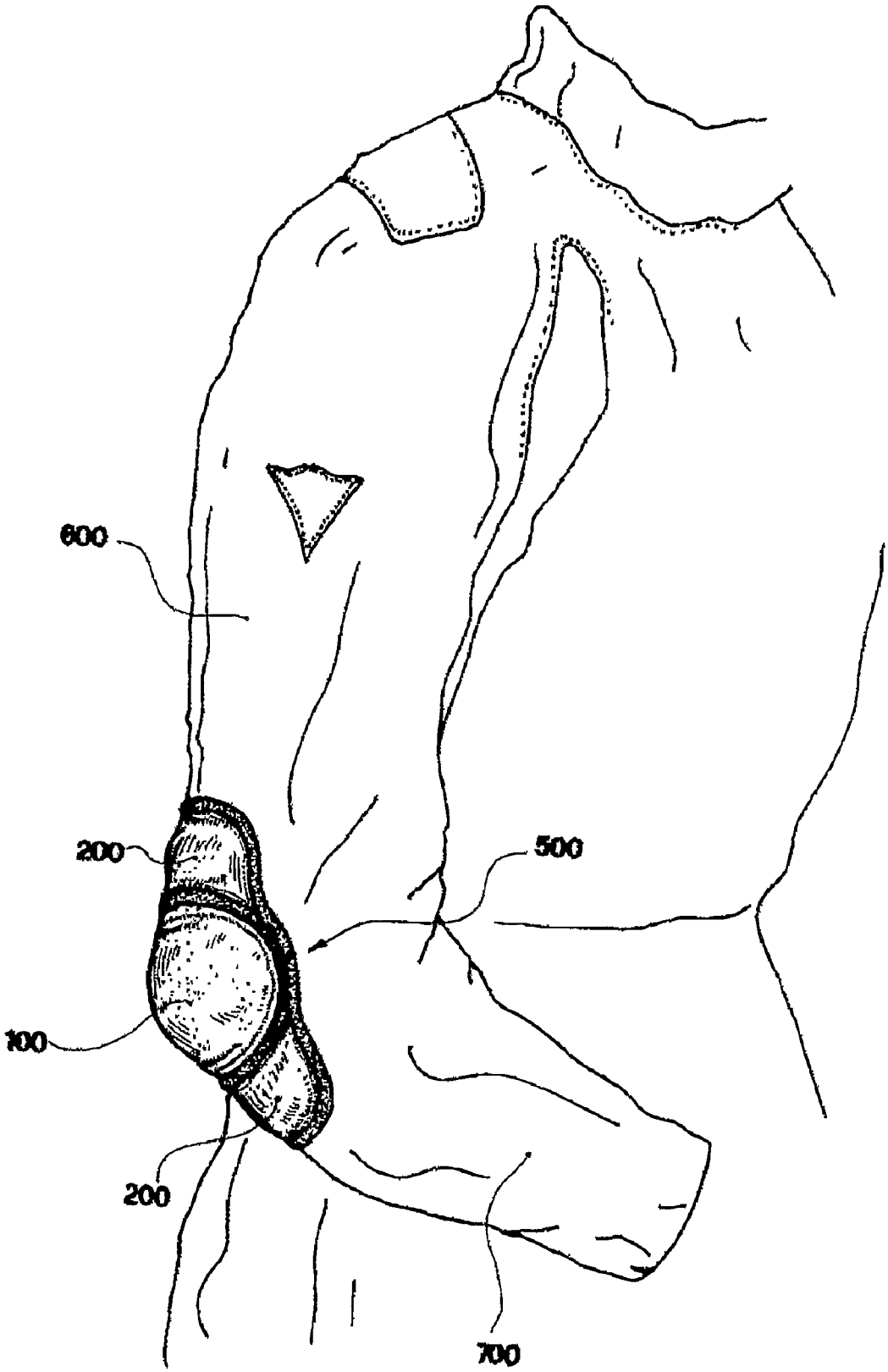
FIG. 1 is a side perspective view showing a protective device according to the present invention and a corresponding zone of the body that the same invention is apt to protect.

Initially referring to FIG. 1, a protective device comprises a first main protective element 100, substantially rigid and apt to be applied at a region to be protected, and at least one ancillary protective element 200, it also substantially rigid, connected to the main protective element by connecting means 300 and apt to defend regions immediately adjacent to those related to the main protective element.

Figure 3:
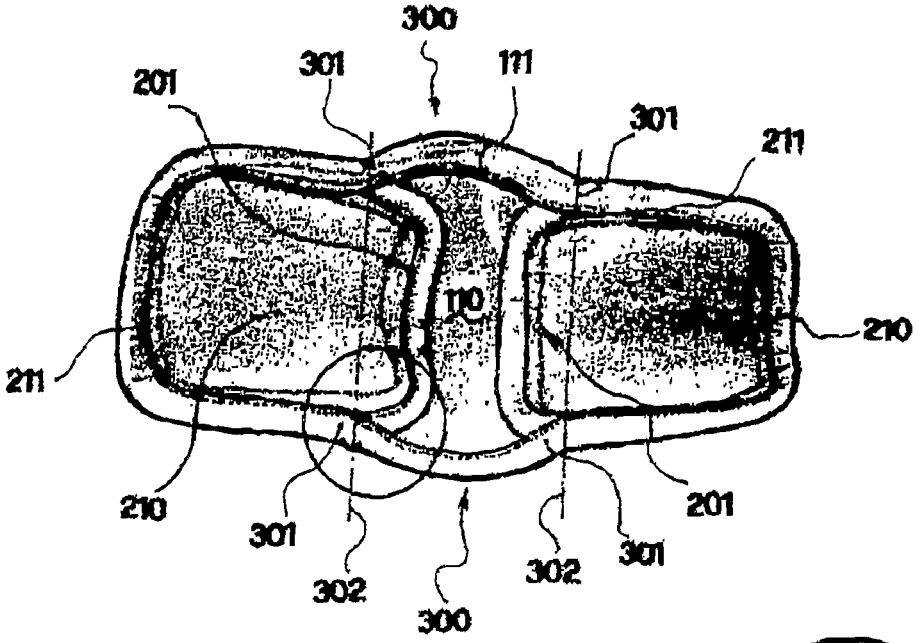
FIG. 3 is a side perspective view illustrating the internal region, with a related padding, of the protective elements and of the related means for connecting the protection of FIG. 1.

The main 100 and ancillary 200 protective elements farther comprise respective paddings 110 and 210, fastened thereto and illustrated in FIG. 3, which are apt to be interposed, during the use of the protection, between the protective elements 100 and 200 and the user's body, so that the latter be in contact with a substantially soft surface.

Moreover, the paddings 110 and 210 have a greater extension with respect to the related protective elements 100 and 200, so that, once fastened, there remain defined respective flexible edges 111 and 211 external to the protective elements 100 and 200 and along the entire periphery thereof.

In case of knock or fall the main protective element 100 and the ancillary elements 200 have the function of making a cover apt to defend the user from the consequences of the impact.

This object is preferably attained by means of the use of a material undergoing no significant deformation under the action of impulsive forces and concomitantly allowing an effective dissipation of the energy deriving from the impact.

In fact, the protection, as it will be detailed hereinafter, is fastened to garments or optionally directly to the body with straps or equivalent means, so as to cover the body region to be protected.

The protection, were it to sustain a significant deformation, would impact against the user's body, potentially causing serious injuries and essentially limiting or nullifying the protective power thereof.

On the other hand, the material forming the protective elements of the protection according to the present invention should also be capable of easily dissipating the energy generated by the impact. Otherwise, the energy might be transmitted directly to the user's body and dissipated by the tissues thereof. However, evidently the energy amount to be disposed of, e.g. in case of fall from a high-speed motor vehicle, could not be absorbed by human body tissues without causing serious lesions, first and foremost fractures.

A plurality of materials implementing these features are known in literature; for instance, there are plastics exhibiting a substantially rigid behavior and concomitantly offering a high capacity of dissipating the energy deriving from the impact, which therefore will not be detailed.

Figure 2:
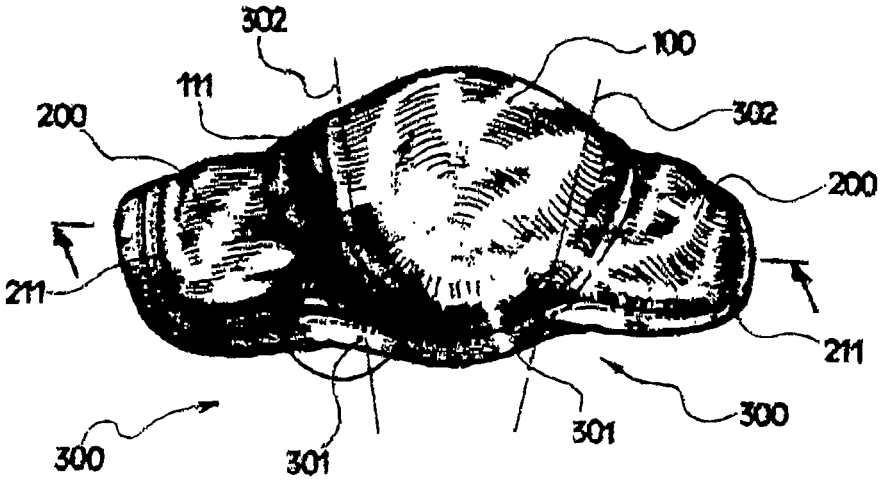
FIG. 2 is a side perspective view illustrating the external region of protective elements and of connecting means thereof for connecting the protection of FIG. 1.
Figure 2A:
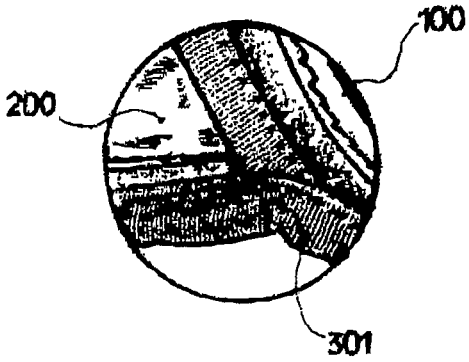
FIG. 2A is a perspective view showing in a detail the connecting means, details of FIG. 2.

Referring to FIGS. 1 and 2, in the present embodiment the main protective element 100 is apt to be used to defend in particular an elbow 500 from knocks and impacts and is applied thereat. Moreover, there are two ancillary protective elements 200, located adjacent to the main element 100.

Evidently, as it will be illustrated in the next embodiments, the same concepts may be extended to make protections for different joint zones, like knees, shoulders, ankles, wrists, neck, back.

Figure 6:
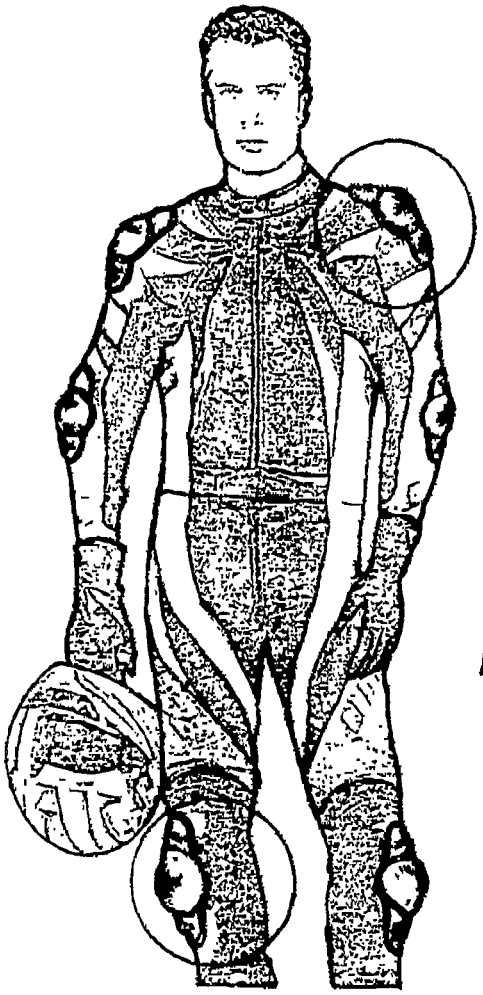
FIG. 6 is a perspective illustration of a garment comprising the protective device according to the present invention on shoulders, elbows and knees.

The protection is applied to the user preferably fastened on a garment, e.g. a motor biker jacket, as illustrated in FIG. 6, or fastened directly to the user's body by straps, not shown in the figure, positioned onto the ancillary protective elements.

In both cases, only the ancillary protective elements 200 rest directly onto the user's body or garment.

Referring to the embodiment disclosed hereto and to FIG. 1, the ancillary protective elements are apt to be applied onto the limbs related to the elbow 500, therefore arm 600 and forearm 700, so that the body portion protected be not limited to a single region protected by the main element 100, but rather a defense from impacts be had also in the zones adjacent thereto.

On the other hand, evidently in case of fall it is advisable that also portions adjacent, e.g., to the elbow 500, be protected from the consequences of a fall.

Figure 2B:
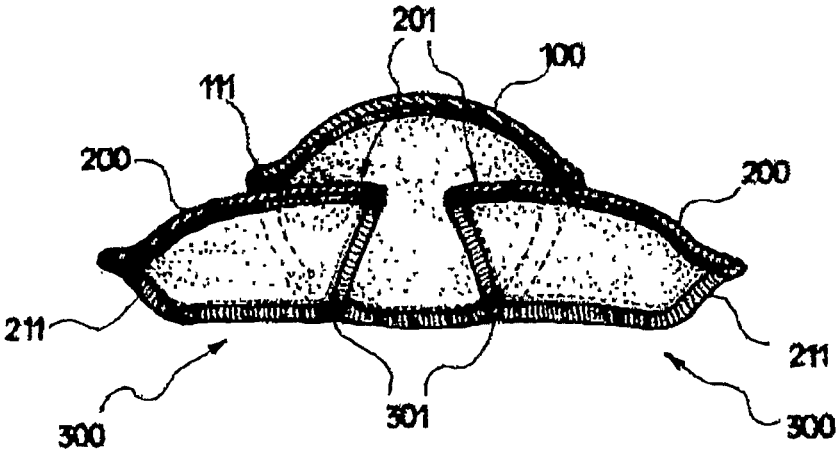
FIG. 2B is a sectional view through the section lines shown in FIG. 2.

Referring to FIGS. 2, 2B and 3, the protection according to the present invention is made with an assembling providing the protective elements 200 to extend, at a respective end region 201, below the main protective element 100.

More precisely, the end regions 201 of the ancillary protective elements 200 are arranged underlying the main protective element 100, so that the main and ancillary protective elements basically appear as a continuous defense.

In other words, the abovedescribed substantially rigid material composing said protective elements continually covers, without any uncovered region, the entire zone concerned by the application of the protection.

Figure 5:
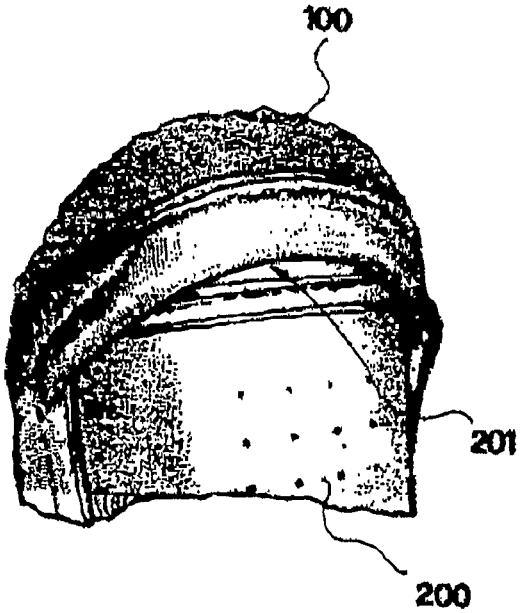
FIG. 5 is a front view of the protective elements in the configuration of FIG. 4, and of ends thereof.
Figure 4:
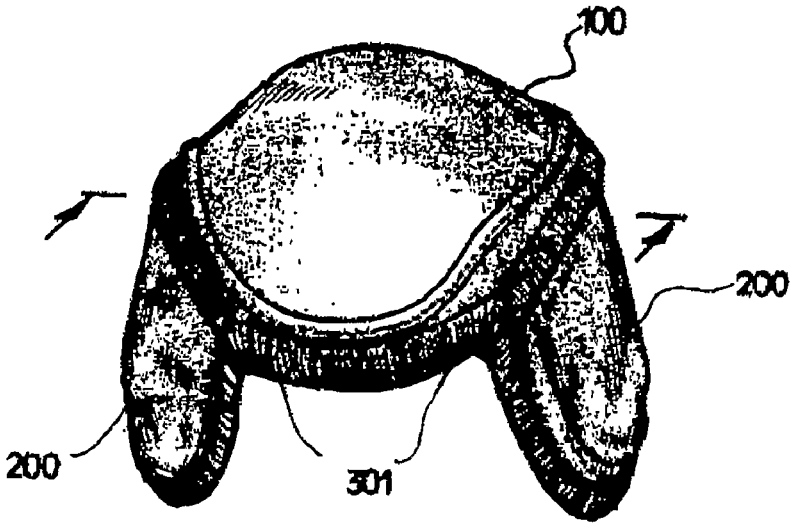
FIG. 4 is a side perspective view illustrating the external region of the protective elements, arranged in a different configuration, at folded arm, and the related connecting means of the protection of FIG. 1.
Figure 4A:
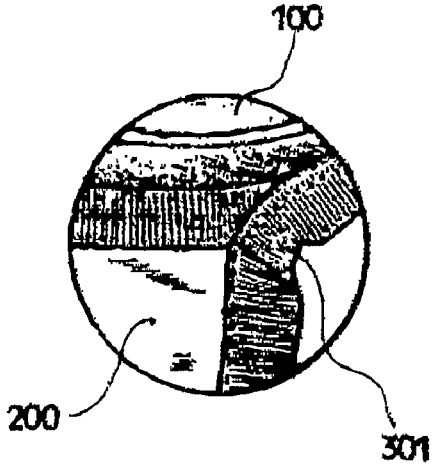
FIG. 4A is a perspective view showing in a detail the connecting means, details of FIG. 4.
Figure 4B:
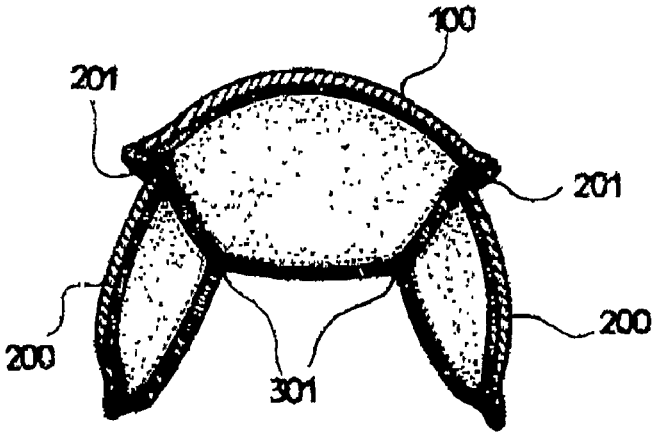
FIG. 4B is a sectional view through the section lines shown in FIG. 4.

Hence, the protection, though assuring an elevated covering surface, comprises no zone left free and therefore undefended by the substantially rigid protective material. Referring to FIGS. 4 and 5, even when the protection is folded, by following the natural motion of the arm when the latter is folded on itself, it appears anyhow continuous; always in the sense that there are no zones undefended by the substantially rigid protection material.

The connecting means 300 makes the connection between the main protective element and the ancillary elements, so that the end regions 201 of the ancillary protective elements 200 be arranged underlying the main protective element 100, in the working configurations described in FIGS. 1 and 4, respectively, for the present embodiment at extended and at folded arm, as well as in those intermediate thereamong.

In order to implement this feature, the connecting means 300 conveniently comprises deformable connections 301 that allow, besides a mutual rotation between the main protective element and the ancillary elements about a main axis 302, also additional rotations with respect to different axes, as well as translation motions nearing thereto and/or away therefrom.

In the present embodiment the deformable connections are a strip-like element 301 fastened at the flexible edges 111 and 211, basically connecting the main protective element 100 and the ancillary elements 200 arranged in the hereto-described configuration.

Moreover, according to the present embodiment and referring to FIGS. 2 and 3, the strip-like element, made e.g. with a fabric strip, extends along the entire periphery of the protection, both in the external region and in that contacting the user's body, thereby enveloping together main 100 and ancillary 200 protective elements, and making said connecting means 300.

The strip-like element 301 allows to obtain substantially a connection similar to that made by tendons in human body, assuring the assembling of the elements in all positions, from the extended-arm one to the folded-arm one, without however being a completely rigid connection.

In fact, it has to be noted that the main motion that should be carried out by the protection is the mutual rotation between main and ancillary protective elements along the main axis 302, axis which is basically parallel to that of rotation, for the present embodiment, of the elbow joint 500.

Figure 3A:
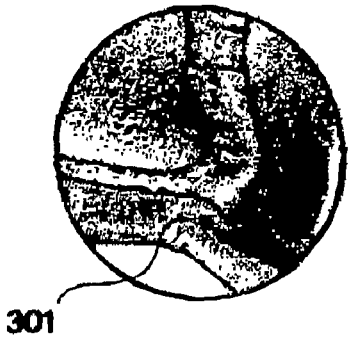
FIG. 3A is a perspective view illustrating in a detail the connecting means, details of FIG. 3.

During said motion, the strip-like element 301 bends, as highlighted in FIG. 3A, yet this action not only implements the mutual rotation of the elements 100 and 200, but also limited rotations with respect to different axes and/or limited translation motions nearing thereto and/or away therefrom.

By means of said limited motions, essentially allowing to arrange the relative position of the ancillary protective elements 200 with respect to the main protective element 100, it is possible to attain the abovedescribed working configurations, so that said ends 201 of the ancillary elements 200 always remain underlying the main element 100.

The shape of the strip-like elements could differ from that of the mere plane strip, e.g. by preceding a central rib for higher resistance, in particular when heavier loads are envisaged in a particular joint.

According to a different embodiment the connecting means 300, and in particular the deformable connections 301 comprised thereby, are a cord-like element, basically connecting the main protective element 100 to the ancillary elements 200.

Unlike in the preceding embodiment, the cord-like element 300 has a substantially circular cross-section, so as to improve the likeness to the tendinous behavior described above.

The cord-like element may conveniently be made of silicon material, easily moldable according to said shape.

On the other hand, the cord-like shape itself, besides giving improved mechanical features, is better susceptible of being made of silicon material or the like, by injection in suitable molds.

Such a production methodology will be better described hereinafter.

In order to assure anyhow continuity in the protection, always in the sense disclosed hereto, the end regions 201 should slide onto the main element 100, so as to always remain in contact therewith. On the other hand this is evident since, starting from the extended-arm configuration in which the elements are substantially aligned therebetween, the latter should arrange substantially at right angle thereamong, keeping anyhow the assembling.

However, a mere rotation with respect to the main axis 302 would not be capable of implementing such a condition and concomitantly the assembling of the protection, in any different configuration, practically from extended arm to the folded position thereof; therefore, the limited motions in other directions and rotations along other axes are apt to cooperate with the main rotation and ensure a perfect continuity of the protective elements 100 and 200.

Moreover, the strip-like element, as well as the cord-like element, assures a greater wearability allowing said motions, and therefore eases the user's motions once the protection is worn-on.

Just since such connecting means make a connection similar to the tendinous one, there are allowed those small adjusting motions that keep the protection perfectly in contact with the user's body during practically any motion thereof, thereby not hampering mobility.

In fact, along with the assurance of maximum protection, freedom of motion is a condition required for all those sports activities taking place at high speeds, yet requiring utmost nimbleness and accuracy of motions, like skiing and skating.

As it will be illustrated in the next embodiments, the same inventive concepts may be used for protections of all joints and in general of any body portion providing a tendinous connection, just because the connecting means 300 emulates this feature of the human body.

Preferably, the material used for the deformable connection 301 has features similar to those of body tendons, therefore being resistant, easily deformable and not overly elastic. Slightly different combinations of these features allow to make protections better adapting to the different zones of the body. This is so since, in some cases and for some applications, it might be advantageous to increase the rigidity or the elasticity of the material, in order to respectively increase the sturdiness or the freedom of motion given by the protection.

Hence, evidently both the strip-like element 301 and the cord-like one, as mentioned hereto, may be replaced by other connections of alike shape, deformable and equivalent, like, e.g., a strip in a polymer material or rubber likewise connecting the protective elements 100 and 200, and optionally also fixed along the entire periphery of the protection, to form said connecting means 300.

The connection between the strip-like element and the edges of the protective elements could be made by any adhesion means: sewing, gluing, etc.

Moreover, it has to be noted that, since generally the impact occurs onto the main protective element, whereas instead the ancillary elements are fastened to the body, if the connecting means 300 were rigid, as anyhow is the case in the known protections, the energy deriving from the knock would be directly transmitted to the other elements and then to the user's body.

Instead, in the protection according to the present invention the connection between main and ancillary elements, by being deformable, allows to dissipate part of the energy deriving from the impact, and basically to reduce the effects deriving from the knock.

Hereinafter it is summarily illustrated the method for the making of the protection according to the present invention, always referring to the present embodiment, it being understood that alike concepts can be extended to the different embodiments as well.

A first production step provides the making of the main and ancillary protective elements e.g. by molding plastics having those features described above and apt to defend from impacts.

This step will not be detailed, as basically known to any person skilled in the art.

A second step provides that onto the main protective element 100 and ancillary protective elements 200 there be sewn, or fastened in an equivalent manner, the respective paddings 110 and 210, leaving defined the flexible edges 111 and 211. Then, the components thus made are arranged aligned, all on a same plane, with the end regions positioned underlying the main protective element 100. Basically, the configuration described immediately above corresponds to that related to the elbow joint at extended arm.

Then, keeping said configuration, the fabric strip 301 is located along the entire periphery of the protection, so as to envelop together and fasten therebetween the main and ancillary protective elements.

The strip-like element 301 could also be positioned exclusively in the zone in which there takes place the connection between main and ancillary element takes place, thereby without completely enveloping the protection.

Alternatively, the protection according to the present invention may be produced always by initially making the main and ancillary protective elements by molding and fastening the paddings thereto; yet, unlike the preceding case, the connecting means is obtained by means of suitable molds allowing the injection of thermoplastic material along the periphery of the elements themselves, so as to obtain a connection analogous to that of the preceding case, yet without the use of any seam.

Such a methodology is particularly suitable for the production of the cord-like elements described above, it being advisable to use the injection process for elements having a substantially circular section.

Always by such a constructive methodology, it is possible to make connecting means having a variable extension of the cross-section, as the use of a related mold with such a feature suffices.

Thus, it is possible to obtain mechanical features variable along the connecting means 300, and in particular in the different portions of the cord-like element. Furthermore, it will be understood that the present invention is susceptible of several embodiments and variants alternative to those described hereto, some of which will summarily be described hereinafter, with reference to the sole aspects differentiating them from the embodiments considered hereto.

In particular, referring to FIG. 6, the protection according to the present invention may be used to make a sports protective garment comprising the same.

In particular, the embodiment is a motor bike suit, comprising the protections according to the present invention applied on shoulders, elbows and knees.

Figure 7:
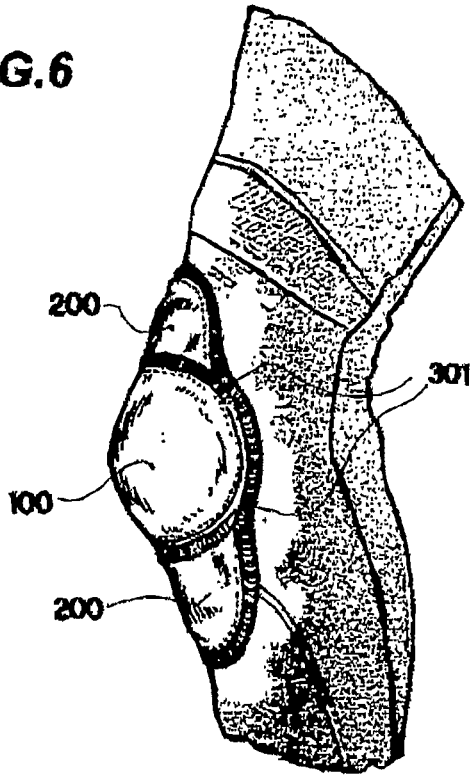
FIG. 7 is a perspective view of the protection according to the present invention applied on a knee, detail of FIG. 6.
Figure 8:
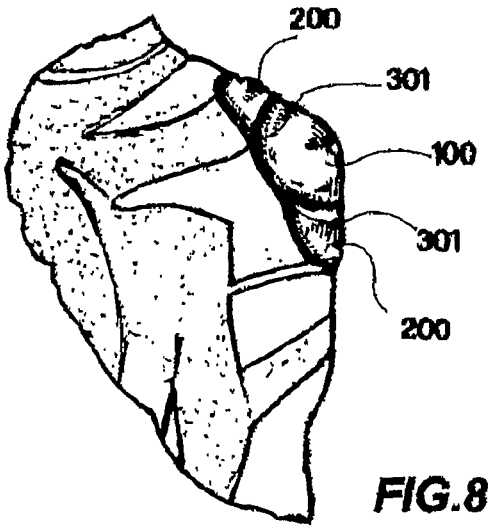
FIG. 8 is a perspective view of the protection according to the present invention applied on a shoulder, detail of FIG. 6.

Referring to FIGS. 7 and 8, evidently the same inventive concepts disclosed in the description of an elbow protection, can also be extended to knees and shoulders, as the sole constructive features that have to be modified to make these protections are linked to the shape and the dimensions of the latter.

Alternatively, the protection according to the present invention may be applied at the wrists; however, in this case there will be a single ancillary protective element 200, extending, adjacent to the main element 100, in a single direction, and anyhow always keeping the edge 201 thereof underlying the latter.

Vice versa, should the protection be used at the back or neck, it could be advantageous the use of more than two ancillary elements, connected to the main protective element, or optionally even exclusively among them, by the connecting means 300 described hereto, so as to attain the hereto-illustrated connecting effect, similar to that made by a tendon of the human body.

Figure 9:
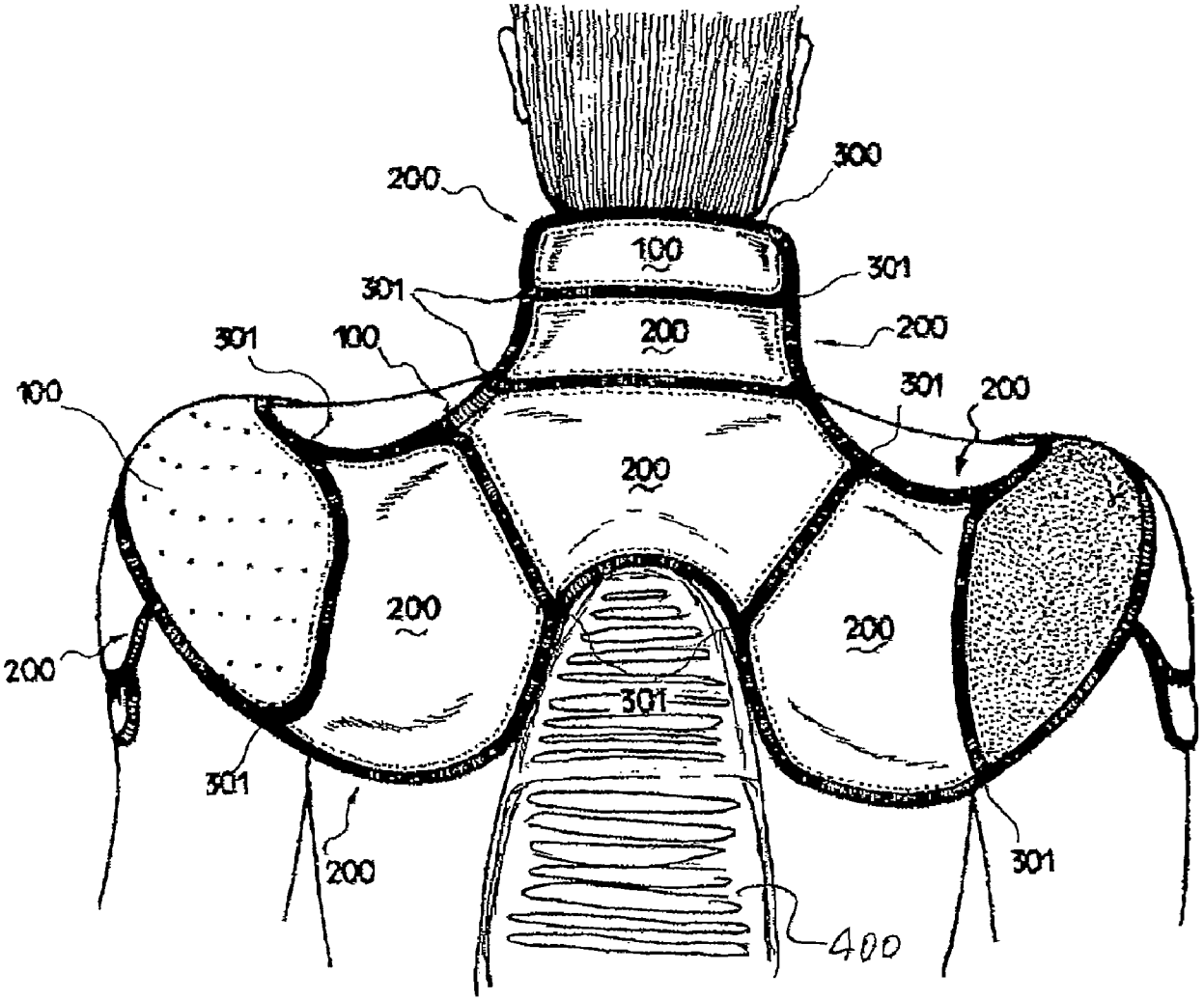
FIG. 9 is a rear view of a protective vest comprising the protective device according to the present invention on chest, shoulder, neck and a back protector.
Figure 10:
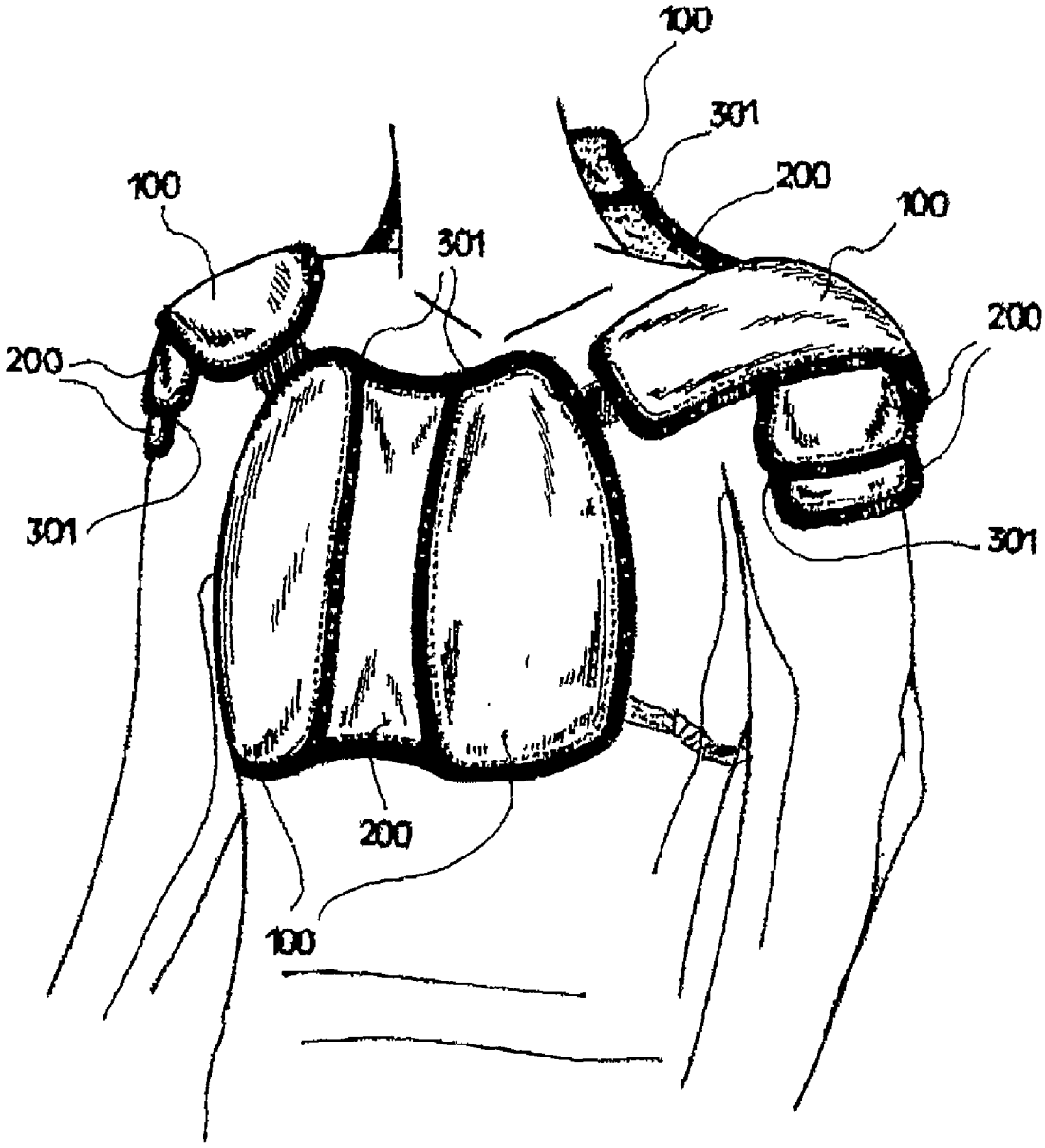
FIG. 10 is a front perspective view of the protective vest of FIG. 9.
Figure 11:
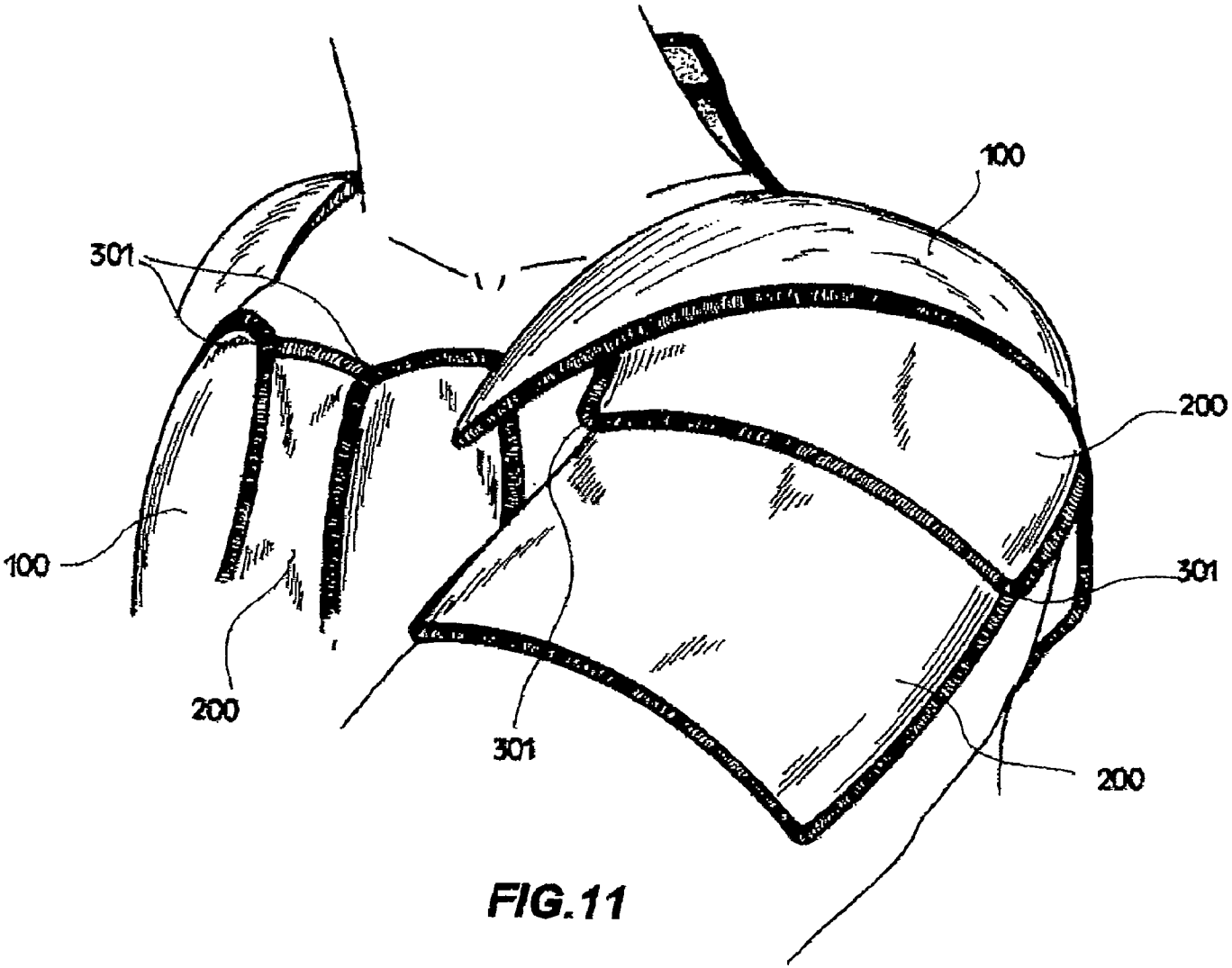
FIG. 11 is a side view of the protective vest of FIG. 9.

A further embodiment is shown in FIGS. 9 to 11. In this case, protective devices according to the present invention are used in a vest to protect neck, shoulders, a part of the chest and the back with a back protector 400.

The main protective element 100 is located in proximity of the back, whereas the ancillary elements 200, arranged always adjacent to the main one, are arranged so as to cover shoulders, chest, neck and, partially, the back.

In particular, in the present embodiment there are six ancillary elements 200, each of them arranged next to the main element, or of one of the elements 200 themselves. Hence, unlike the preceding embodiment, the ends 201 of an ancillary element 200 not only can underlie a main protective element 100, but also a further ancillary element.

Such a feature allows to obtain protective devices defending an even broader body region with respect to the preceding embodiment, without however limiting the user's mobility.

The connecting means 300 is always apt to allow limited motions in all directions, whereas now the rotation about the main axis is different depending on the location of the ancillary element.

For instance, the ancillary elements covering the neck and the upper portion of the back, can, by means of said connecting means, mutually rotate so as to follow the tilting that the head may perform forward or backward with respect to the body, and therefore always assuring the utmost mobility.

In addition, evidently the head may also perform different motions, such as lateral torsions and shifting: the deformability of the deformable connections 301, which again can be strip-like elements or cord-like elements, allows the protective elements forming the protective device according to the present invention to perform limited rotations and/or translations to adjust to said motions.

In the present embodiment, the protective device further comprises two ancillary protective elements apt to cover the chest and basically forming a vest together with the remaining protective elements. Thus, the protective device may be worn-on without the aid of any strap and without having to be applied to a garment. In fact, the protective elements apt to cover the chest comprise also fastening means, not shown in the figure, connectable e.g. with Velcro® inserts or with adjustable hooks. The use of a plurality of ancillary protective elements 200, connected by said connecting means 300, allows an improved dissipation of the energy due to the impact, since, as already explained hereto, even when the knock occurs at a single element only, the energy will be transmitted also to all elements to which it is connected.

In the present embodiment the connecting means 300 allows, besides providing freedom of motion to the user, also to easily wear the protective device.

Referring to FIG. 9, it may be observed that in cooperation with the protective devices it is also used a back protector 400, made according to the known art, allowing an improved defense of the back, which is particularly exposed to lesions in case of falls.

In fact, referring to FIG. 10, the protective device according to the present embodiment comprises connecting means also at the lateral zones of the chest, so as to open the device and then close it back into the vest-like configuration described above, in order to wear it.

Moreover, evidently an ancillary protective element 200 could underlie more than one main element 100, and therefore the protective device could also comprise more than one main protective element 100.

Figure 12:
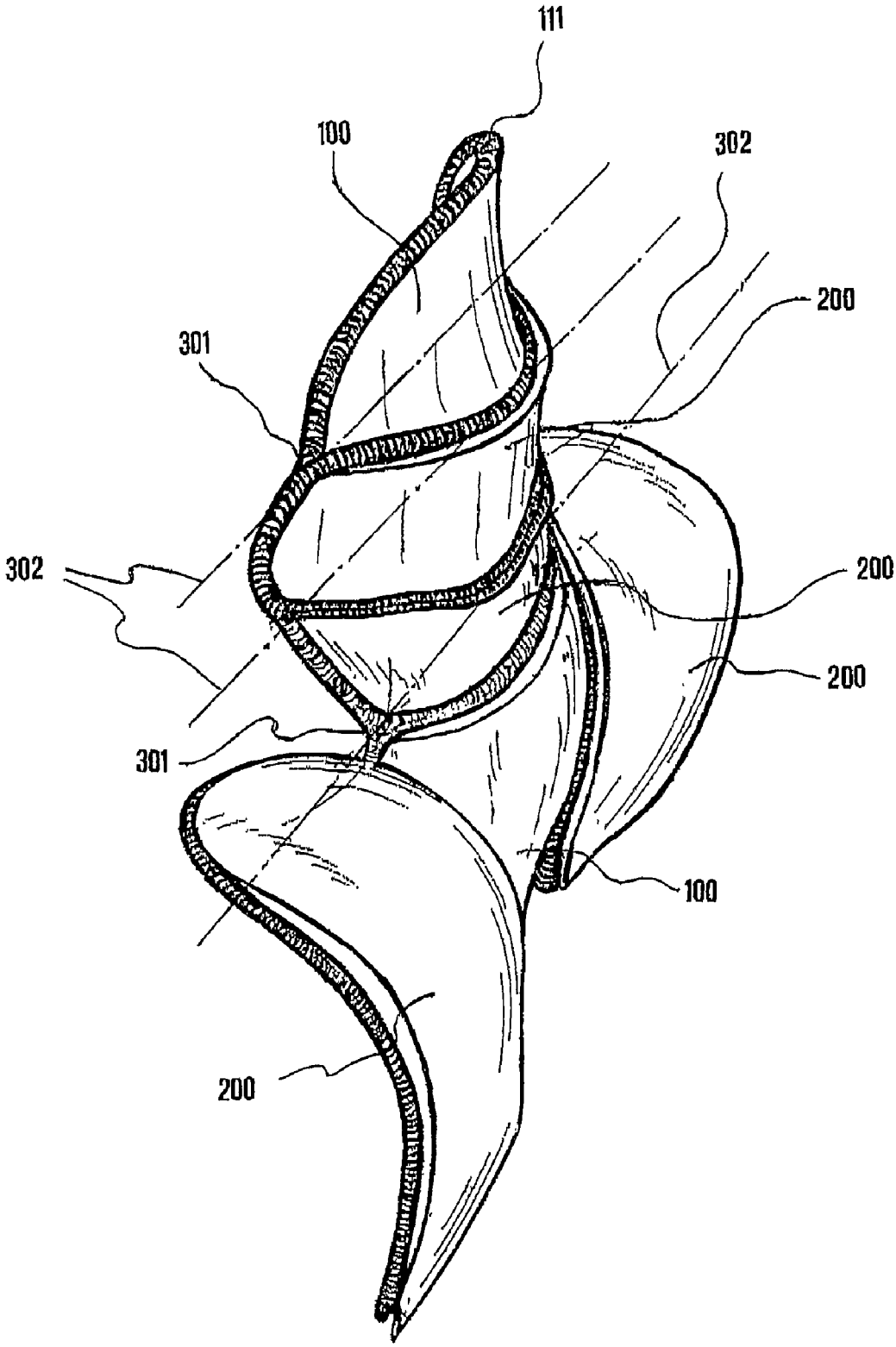
FIG. 12 is a perspective view of a further embodiment of the protective device according to the present invention, applied at the neck.

According to a further embodiment, illustrated in FIG. 12, the protective device according to the present invention may also be used to make a neck protection.

In this case, the possibility of motion offered by the connecting means advantageously allows limited lateral shifting of the neck and to contain the backward tilting of the neck.

In fact, during the rotations about the axes 302, the ends 201 slide against the main element 100.

This feature is linked to the fact that, in order for the ancillary protective elements 200 to remain, in any configuration, underlying the main element 100, during the rotation a certain interference takes place between the ends 201 and the padding 110. Such interference is anyhow limited; above all, the deformability of the connecting means, of the ends 201 and of the padding, does not hamper the rotation or the other motions.

Such a feature, though common to all of the embodiments described hereto, proves particularly useful in case of a neck protection, as allowing to dampen the backward tilting of the neck, and dissipating, at least partially, the energy pushing it backward. The present invention has hereto been described with reference to preferred embodiments thereof. It is understood that there may be other embodiments referable to the same inventive concept, all falling within the protective scope of the claims set forth hereinafter.

The invention claimed is:

1. A protective device comprising:

at least one substantially rigid main protective element, apt to be applied at a region of a user's body to be protected;

at least one substantially rigid ancillary protective element, apt to be applied in a position next to said main protective element; and connecting means for connecting said at least one ancillary protective element to said main protective element, wherein a respective padding is fastened to each of the main protective element and the ancillary protective element, the padding extending externally to the respective substantially rigid main and ancillary protective elements and defining a peripheral flexible edge of the main protective element and a peripheral flexible edge of the ancillary protective element, wherein the ancillary protective element comprises an end region that is arranged underlying the main protective element, wherein said connecting means connects the peripheral flexible edge of the main protective element and the peripheral flexible edge of the ancillary protective element, said connecting means implementing a deformable connection configured to allow a mutual rotation between the main protective element and the ancillary protective element about a main axis and to allow limited additional rotations about axes different from said main axis and/or limited translation motions, wherein said connecting means comprises a strip-like element fastened to the peripheral flexible edges of the main protective element and the ancillary protective element, the strip-like element extending along the entire periphery of the protective device and holding together said main protective element and said ancillary protective element.

2. The protective device of claim 1, wherein said end region of the ancillary protective element is arranged underlying the main protective element in any operative configuration of the protective device.

3. A protective garment comprising at least one protective device of claim 1, said protective device being in a region of at least one user's body joint zone, the joint zone being selected from a group consisting of: shoulder, elbow, knee, neck.

4. The protective garment of claim 3, wherein the protective device is fastened on said garment.

5. The protective garment of claim 4, wherein only the ancillary protective element rests directly onto the protective garment.

6. The protective device of claim 1, comprising two ancillary protective elements located at opposite sides of said main protective element.

7. The protective device of claim 1, comprising fastening means for fastening the protective device to the user's body.

8. The protective device of claim 7, wherein the fastening means is positioned onto the ancillary protective element.

9. The protective device of claim 1, wherein the strip-like element extends both in the external region and in the region contacting the user's body.

10. A protective device comprising:

at least one substantially rigid main protective element, apt to be applied at a region of a user's body to be protected;

at least one substantially rigid ancillary protective element, apt to be applied in a position next to said main protective element; and connecting means for connecting said at least one ancillary protective element to said main protective element, wherein a respective padding is fastened to each of the main protective element and the ancillary protective element, the padding extending externally to the respective substantially rigid main and ancillary protective elements and defining a peripheral flexible edge of the main protective element and a peripheral flexible edge of the ancillary protective element, wherein the ancillary protective element comprises an end region that is arranged underlying the main protective element, wherein said connecting means connects the peripheral flexible edge of the main protective element and the peripheral flexible edge of the ancillary protective element, said connecting means implementing a deformable connection configured to allow a mutual rotation between the main protective element and the ancillary protective element about a main axis and to allow limited additional rotations about axes different from said main axis and/or limited translation motions, wherein said connecting means comprises a cord-like element fastened to the peripheral flexible edges of the main protective element and the ancillary protective element, the cord-like element extending along the entire periphery of the protective device and holding together said main protective element and said ancillary protective element.

11. The protective device of claim 10, wherein said cord-like element has a cross-section of variable extension.

12. The protective device of claim 10, wherein said cord-like element has a substantially circular cross-section.

13. The protective device of claim 10, wherein said cord-like element is made of silicon material.

14. The protective device of claim 10, wherein said end region of the ancillary protective element is arranged underlying the main protective element in any operative configuration of the protective device.

15. The protective device of to claim 10, comprising two ancillary protective elements located at opposite sides of said main protective element.

16. The protective device of claim 10, comprising fastening means for fastening the protective device to the user's body.

17. The protective device of claim 16, wherein the fastening means is positioned onto the ancillary protective element.

18. A protective garment comprising at least one protective device of claim 10, said protective device being in a region of at least one user's body joint zone, the joint zone being selected from a group consisting of: shoulder, elbow, knee, neck.

19. The protective garment of claim 18, wherein the protective device is fastened on said protective garment.

20. The protective garment of claim 18, wherein only the ancillary protective element rests directly onto the protective garment.

* * * * *